US006362131B1

(12) United States Patent
Horii et al.

(10) Patent No.: US 6,362,131 B1
(45) Date of Patent: Mar. 26, 2002

(54) THERMALLY TRANSFERRED SHEET

(75) Inventors: Akihiro Horii; Tetsuo Kozumi; Masayoshi Isago, all of Miyagi; Hirokazu Okada, Saitama; Masataka Mizoguchi, Chiba, all of (JP)

(73) Assignees: Sony Corporation; Fujikura Kasei Co., Ltd., both of Tokyo (JP)

( * ) Notice: Subject to any disclaimer, the term of this patent is extended or adjusted under 35 U.S.C. 154(b) by 0 days.

(21) Appl. No.: 09/496,156

(22) Filed: Feb. 1, 2000

(30) Foreign Application Priority Data

Feb. 3, 1999 (JP) ..... P11-026240

(51) Int. Cl.[7] ..... B41M 5/035

(52) U.S. Cl. ..... 503/227; 428/195; 428/211; 428/500; 428/913; 428/914

(58) Field of Search ..... 8/471; 503/227; 428/500, 913, 914, 195, 211

(56) References Cited

U.S. PATENT DOCUMENTS 5,006,502 A * 4/1991 Fujimura et al. ..... 503/227

* cited by examiner

*Primary Examiner*—Bruce H. Hess
(74) *Attorney, Agent, or Firm*—Sonnenschein, Nath & Rosenthal

(57) ABSTRACT

A receiver paper used in combination with a thermally transferrable sheet, such as an ink ribbon, in which a laminated layer of the thermally transferrable sheet can be positively transferred, with the receiver paper exhibiting superior running performance and resistance to blocking to enable a picture of high quality and high resolution to be produced. To this end, there is provided a receiver paper made up of substrate and a dye reception layer formed on the substrate. The dye reception layer contains a copolymer of a compound having a pre-set chemical formula and another monomer.

2 Claims, 1 Drawing Sheet

THERMALLY TRANSFERRED SHEET

FIELD OF THE INVENTION

The present invention relates generally to a receiver paper used in combination with a thermally transferable sheet, such as an ink ribbon, and on to which the dye from the thermally transferable sheet is transferred on application of heat.

BACKGROUND OF THE INVENTION

A method employing a sublimable dye or a thermally fusible dye is used for developing the picture information inputted to a video apparatus onto a receiver paper, such as a printing paper sheet.

In this thermal transfer method, a thermally transferrable sheet (ink ribbon) having formed thereon a dye layer containing a sublimable dye or a thermally fusible dye, and a receiver paper (printing paper sheet), having formed thereon a reception layer for receiving the dye, are superimposed on one another, so that the dye layer will face the reception layer, and heat is applied by e.g., a thermal head in a dot pattern responsive to picture signals. This causes the dye in the dye layer to be sublimed or fused and transferred to the reception layer of the printing paper sheet to manifest the picture on the printing paper sheet.

This receiver paper is of a dual layer structure comprised of a sheet-like substrate and the reception layer formed thereon. This reception layer is a layer for receiving a picture of a dye transferred from the ink ribbon, for example, a picture of a sublimable disperse dye, and for maintaining the picture formed on reception, and is routinely formed of a resin exhibiting dyeing properties, such as polyester, polycarbonate or polyvinyl chloride.

For improving heat resistance, polyisocyanate, as a hardener, is sometimes added to the reception layer. Also, for improving transfer sensitivity and light-fastness, that is resistance to light, plasticizers are sometimes added to the reception layer. In addition, silicone oil, as a release agent, is sometimes added to the reception layer for improving peeling of the receiver paper from the dye layer surface.

On the other hand, the thermally transferrable sheet is routinely comprised of a substrate of, for example, polyester, and ink layers of respective colors, namely yellow, magenta, cyan and, if necessary, black, formed surface-sequentially thereon. In addition to the respective ink layers, a laminate layer may be provided, which is tranferred as a protective layer on the reception layer after forming the picture on the receiver paper. That is, the thermally transferrable sheet, carrying the laminated layer, can form a protective layer on the reception layer of the receiver paper.

If, in the above-described receiver paper, the transfer properties of the laminate layer are to be improved, it may be contemplated to decrease the amount of addition of a hardener, such as polyisocyanate, which is added to the reception layer, or to add a plasticizer to the reception layer to lower the glass transition temperature of the resin to soften the reception layer. However, in such case, the ink surface of the thermally transferrable sheet is fused to the reception layer of the receiver paper to detract from the quality of the formed picture or to cause running troubles. Also, the reception layer is softened in this case, so that, if plural receiver papers stacked together for storage under high temperature conditions, the so-called blocking, in which the reception layer 2 tends to be stuck to the back surface of the receiver paper, is likely to be produced.

On the other hand, if, in the above-described receiver paper, the running performance or resistance to blocking under high temperature conditions is to be improved, it may be contemplated to increase the amount of addition of the hardener, such as polyisocyanate, to harden the reception layer, or to increase the amount of addition of silicone oil to improve release properties between the thermally transferrable sheet and the receiver paper. However, in this case, the laminate layer of the receiver paper is worsened in transfer characteristics such that the laminate layer cannot be transferred or transferred only incompletely.

Thus, in the conventional receiver paper, there is a relation of trade-off between the transfer characteristics of the laminate layer on one hand and the running performance and resistance against blocking under high temperature conditions, such that the two requirements cannot be met simultaneously.

SUMMARY OF THE INVENTION

It is therefore an object of the present invention to provide a receiver paper onto which the laminate layer of the thermally transferrable sheet can be positively transferred and which exhibits superior running performance and resistance to blocking to enable a picture of high quality and high resolution to be produced.

The present invention provides a receiver paper made up of a substrate and a dye reception layer formed thereon, wherein the dye reception layer contains a copolymer of a compound having the following formula (1):

Formula (1)

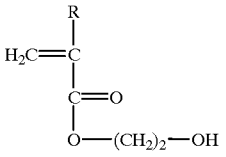

wherein R is H or $CH_3$, with another monomer, and wherein the proportion in the copolymer of the compound having the formula (1) ranges from 5 to 25 wt %.

With the above-described receiver paper according to the present invention, in which a copolymer of the compound shown by the chemical formula (1) and an acrylic resin is used as a material for the receiver paper, and in which the proportion in the copolymer of the compound shown by the chemical formula (1) is prescribed to a pre-set range, the dye reception layer can be set to a desired state of flexibility. Specifically, the proportion of the compound having the chemical formula (1) is set to 5 to 25 wt %. If the proportion of the compound having the chemical formula (1) is set to less than 5 wt %, the dye reception layer is lowered in strength, whereas, if the proportion of the compound having the chemical formula (1) is set to larger than 25 wt %, the glass transition temperature of the copolymer becomes low to soften the dye reception layer excessively.

Other objects and advantages of the present invention will become apparent upon reading the following detailed description and appended claims, and upon reference to the accompanying drawings.

Figure 1:
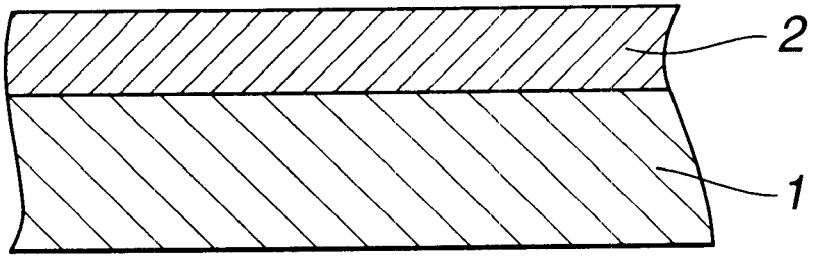
FIG. 1 is a cross-sectional view showing essential portions of a receiver paper according to the present invention.

It should be understood that the drawings are not necessarily to scale and that the embodiments are sometimes illustrated by graphic symbols, phantom lines, diagrammatic representations and fragmentary views. In certain instances, details which are not necessary for an understanding of the invention or which render other details difficult to perceive may have been omitted. It should be understood, of course, that the invention is not necessarily limited to the particular embodiments illustrated herein.

DESCRIPTION OF THE PRESENTLY PREFERRED EMBODIMENTS

Referring to the drawings, a preferred embodiment of a receiver paper according to the present invention will be explained in detail.

FIG. 1 shows an example of a receiver paper according to the present invention. This receiver paper is used as a so-called printing paper sheet in combination with a thermally transferrable sheet, such as an ink ribbon, having a dye layer containing a dye, to form a desired picture by the dye transferred from the thermally transferrable sheet.

This receiver paper includes a sheet-like substrate 1 and a dye reception layer 2 formed on the substrate 1 for receiving the dye. With the present receiver paper, the dye is migrated from the thermally transferrable sheet to the dye reception layer 2, responsive to e.g., video signals, to form an image by selective heat application by a thermal head.

Figure 2:
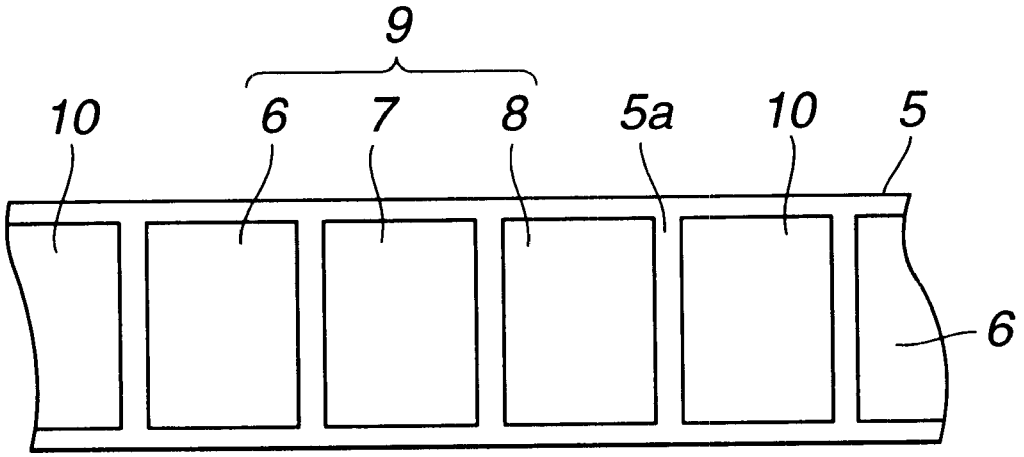
FIG. 2 is a plan view showing essential portions of a thermally transferrable sheet.

Referring to FIG. 2, the thermally transferrable sheet is made up of a substrate of the thermally transferrable sheet 5, an ink layer 9 having a yellow dye layer 6, a magenta dye layer 7 and a cyan dye layer 8, and which is arranged on a major surface 5*a* of the substrate 5, and a laminate layer 10 arranged on the major surface 5*a* of the thermally transferrable sheet 5 adjacent to the ink layer 9. The receiver paper is combined with the thermally transferrable sheet, with the dye reception layer 2 facing the ink layer 9, in order to form an image.

In the receiver paper, the substrate 1 may be a routinely used substrate, such as paper, inclusive of a high-quality paper sheet and a coated paper sheet, or a variety of plastics sheets, or compound sheets of the paper and plastic sheets.

In addition, in the thermally transferred sheet, the dye reception layer 2 contains a copolymer comprised of a compound represented by the chemical formula (1):

Formula (1)

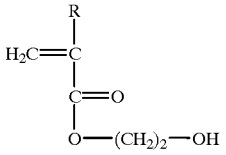

wherein R is H or $CH_3$, and other monomers.

In the present receiver paper, the above-mentioned other monomers may be enumerated by acrylic or methacrylic acid esters, such as phenoxy polyethylene glycol methacrylate, methyl methacrylate, ethyl methacrylate, phenyl methacrylate, cyclohexyl methacrylate, isoboronyl methacrylate or amino ethyl methacrylate, vinyl monomers, such as styrene, chlorostyrene or vinyl phenol, and vinyl aromatic carboxylic acid esters, such as vinyl benzoate or vinyl chlorobenzoate. These may be used alone or in combination.

The copolymer may be manufactured by any techniques, there being no limitation as to the sort of the manufacturing method. Specifically, the copolymer may be manufactured by a suspension polymerization method, block polymerization method, solution polymerization method or by an emulsion polymerization method.

In particular, in the present receiver paper, the proportions of the ingredients of the copolymer made up of the compound of the chemical formula (1) and other monomers are prescribed so that the compound of the chemical formula (1) accounts for 5 to 25 wt% of the copolymer.

If the proportion of the chemical formula (1) in the copolymer is less than 5 wt %, the amount of hydroxy groups reacted with isocyanates added as a hardener is not sufficient, with the result that the strength of the dye reception layer 2 by the hardener is lowered.

In particular, if the thermally transferrable sheet has the aforementioned laminate layer 10, since the hydroxy groups in the chemical formula (1) are polar groups, there is produced a bond between the resin constituting the laminate layer 10 and the hydroxy group. If, in such case, the proportion of the compound of the chemical formula (1) in the copolymer of the dye reception layer 2 is less than 5 wt %, the hydroxy groups for forming the bond with the resin of the laminate layer 10 fall in shortage. Thus, if the proportion of the compound of the chemical formula (1) in the copolymer of the dye reception layer 2 is less than 5 wt %, it becomes impossible to transfer the laminate layer 10 positively to the dye reception layer 2.

Also, if the proportion of the chemical formula (1) exceeds 25 wt %, the glass transition temperature of the copolymer is too low, such that the dye reception layer 2 is softened excessively to lower the running performance at elevated temperatures, thus producing the blocking. Moreover, the dye reception layer 2 is worsened in surface luster, thus tending to detract from the quality of the produced image.

The weight average molecular weight of the copolymer is preferably 100,000 to 1,000,000. If the weight average molecular weight of the copolymer is less than 100,000, the dye reception layer 2 tends to become brittle to worsen the film forming characteristics at the time of formation of the dye reception layer 2. On the other hand, if the weight average molecular weight of the copolymer exceeds 1,000,000, the paint tends to be increased in viscosity to present coating difficulties in applying the paint containing the copolymer to form the dye reception layer 2.

On the other hand, inorganic pigments, such as titanum oxide, calcium carbonate or zinc oxide, or fluorescent whitening agents, may be added to the dye reception layer 2 to improve the whiteness. Mold release agents may also be added to the dye reception layer 2. Examples of the mold release agents include silicone oils, such as methyl styrene modified silicone oil, olefin modified silicone oil, polyether modified silicone oil, fluorine modified silicone oil, epoxy modified silicone oil, carboxy modified silicone oil, amino modified silicone oil or carbinol modified silicone oil, and fluorine-based mold release agents.

The dye reception layer 2 may preferably added to with a hardener for improving its film characteristics. The hardeners may be exemplified by, for example, epoxy based hardeners, isocyanate-based hardeners, and in particular by a non-yellow-becoming type polyfunctional isocyanate compounds. These polyfunctional isocyanate compounds may be enumerated by, for example, hexamethylene diisocyanate (HDI), xylene diisocyanate (XDI), toluene diisocyanate (TDI) and piurette. These hardeners may be used alone or in combination.

For the dye reception layer 2, an anti-static agent is preferably used to prevent static charges from being produced when the sheet is run in a printer apparatus. The anti-static agent may be enumerated by, for example, cationic surfactants, such as quaternary ammonium salts or polyamine derivatives, anionic surfactants, such as alkylbenzene sulfonate or alkyl sulfate ester sodium salts, amphoteric ion surfactants, and nonionic surfactants. These anti-static agents may be added to the dye reception layer 2 or coated on the surface thereof.

The dye reception layer 2 may also be added to with plasticizers as necessary. The plasticizers may be enumerated by phthalic acid esters, adipic acid esters, trimellitic acid esters, pyromellitic acid esters and polyphenol esters. The dye reception layer 2 may also be added to with ultraviolet light absorbers or anti-oxidants to improve shell life. The ultraviolet light absorbers may be enumerated by benzophenone-based, diphenyl acrylate based or benzotriazole-based ultraviolet light absorbers, whilst the anti-oxidants may be enumerated by phenol-based, organic sulfur based, phosphite-based or phosphoric acid based agents.

In the receiver paper, constructed as described above, since the dye reception layer 2 is formed to have desired hardness, it is possible to prevent the dye reception layer 2 from being fused to the ink layer 9 to assure excellent picture quality. Also, in the present receiver paper, since the dye reception layer 2 has desired hardness, there is no risk of occurrence of so-called blocking, in which the dye reception layer 2 becomes attached to the back surface of the neighboring substrate 1, even if plural sheets are stored in a stacked state under high temperature conditions. Thus, the present receiver paper exhibits superior running performance even under elevated temperature conditions.

Moreover, the present receiver paper exhibits superior film characteristics if it is added to with a hardener, such as isocyanates. That is, in the receiver paper, isocyanate groups are reacted efficiently with hydroxy groups of the chemical formula (1), even if the receiver paper is added to with a hardener, such that the operation of the hardener, such as isocyanates, occurs reliably.

Also, the present receiver paper is preferably added to with a mold release agent, such as silicone oil. With the present receiver paper, added to with the mold release agent, such as silicone oil, isocyanate groups are reacted efficiently with the hydroxy groups of the chemical formula (1) to suppress the reaction of the isocyanate group with the silicone oil. If the polymer contained in the dye reception layer 2 is not provided with the compound shown by the chemical formula (1), isocyanates are reacted with the hydroxy groups in the silicone oil to bleed on the surface of the dye reception layer 2 along with the silicone oil. If the isocyanates are bled on the surface of the dye reception layer 2, transfer characteristics of the laminate layer 10 are lowered.

Conversely, with the above-described receiver paper, the hardener, such as isocyanates, is reacted efficiently with the compound of the chemical formula (1), to suppress bleeding of the hardener to permit satisfactory transfer of the laminate layer 10. Thus, the present receiver paper is able to demonstrate an image of high quality and high resolution.

EXAMPLES

The present invention is now explained with reference to illustrative Examples of the receiver paper according to the present invention in comparison with Comparative Examples.

EXAMPLES 1 to 31

In the Examples 1 to 31, synthetic paper sheets, 150 $\mu$m thickness, manufactured by OJI YUKA CO. LTD., under the trade name of YUPO FPG-150, were used as the sheet-like substrates. Also, the paint for forming the dye reception layer was fabricated from the components shown in Table 1:

TABLE 1

| paint for forming a reception layer | parts by weight |
|---|---|
| resin components of the reception layer (copolymers of Tables 2 to 5) | 100 |
| silicone oil (*1) | 5 |
| isocyanate compounds (*2) | 10 |

(*1) SFB427: manufactured by TORAY DOW CORNING INC.
(*2) n.-75 manufactured by NIPPON POLYURETHANE CO. LTD.

As the copolymer component in the paint for the dye reception layer, pre-set amounts of "hydroxy ethyl acrylate" and/or "hydroxy ethyl methacrylate" shown by the above chemical formula were contained in the paint composition, as shown in Tables 2 and 3.

TABLE 2

| | | | (other monomers) | | | | |
|---|---|---|---|---|---|---|---|
| copolymer components (wt. %) | hydroxy ethyl acrylate | hydroxy ethyl methacrylate | phenoxy ethyl methacrylate | phenoxy ethoxy ethyl methacrylate | methyl methacrylate | isoboronyl methacrylate | styrene |
| Ex. 1 | 5 | — | 50 | — | 25 | 10 | 10 |
| Ex. 2 | 10 | — | 45 | — | 25 | 10 | 10 |
| Ex. 3 | 15 | — | 45 | — | 20 | 10 | 10 |
| Ex. 4 | 20 | — | 40 | — | 20 | 10 | 10 |
| Ex. 5 | 25 | — | 40 | — | 15 | 10 | 10 |
| Ex. 6 | 5 | — | — | 50 | 35 | 10 | 10 |
| Ex. 7 | 10 | — | — | 45 | 35 | 10 | 10 |
| Ex. 8 | 15 | — | — | 45 | 35 | 10 | 10 |
| Ex. 9 | 20 | — | — | 40 | 30 | 10 | 10 |
| Ex. 10 | 25 | — | — | 40 | 25 | 10 | 10 |
| Ex. 11 | | 5 | 50 | — | 25 | 10 | 10 |
| Ex. 12 | | 10 | 45 | — | 25 | 10 | 10 |
| Ex. 13 | | 15 | 45 | — | 20 | 10 | 10 |
| Ex. 14 | — | 20 | 40 | — | 20 | 10 | 10 |
| Ex. 15 | — | 25 | 40 | — | 15 | 10 | 10 |

TABLE 3

| copolymer components (wt. %) | hydroxy ethyl acrylate | hydroxy ethyl methacrylate | (other monomers) phenoxy ethyl methacrylate | phenoxy ethoxy ethyl methacrylate | methyl methacrylate | isoboronyl methacrylate | styrene |
|---|---|---|---|---|---|---|---|
| Ex. 16 | 5 | 10 | 40 | — | 25 | 10 | 10 |
| Ex. 17 | 10 | 10 | 40 | — | 20 | 10 | 10 |
| Ex. 18 | 15 | 10 | 35 | — | 20 | 10 | 10 |
| Ex. 19 | 10 | 5 | 40 | — | 25 | 10 | 10 |
| Ex. 20 | 10 | 15 | 40 | — | 15 | 10 | 10 |
| Ex. 21 | 5 | 5 | 45 | — | 25 | 10 | 10 |
| Ex. 22 | 10 | — | 90 | — | — | — | — |
| Ex. 23 | 10 | — | — | 90 | — | — | — |
| Ex. 24 | — | 10 | — | — | 90 | — | — |
| Ex. 25 | — | 10 | 90 | — | — | — | — |
| Ex. 26 | — | 10 | — | 90 | — | — | — |
| Ex. 28 | 10 | — | 10 | — | 50 | — | 30 |
| Ex. 29 | — | 10 | 10 | — | 50 | — | 30 |
| Ex. 30 | 5 | 5 | 10 | — | 50 | — | 30 |
| Ex. 31 | 5 | 5 | 45 | 15 | — | 10 | 20 |

On the other hand, the paint for the dye reception layer was prepared by dissolving the sum total of the solid ingredients of Table 1 so as to be a 20% solution in a 1/1 weight ratio mixed solvent of methyl ethyl ketone/toluene, by stirring the solution in a dissolver and by passing the solution through a filter 50 $\mu$m in diameter. The paint for the dye reception layer, thus obtained, was coated on the surface of a sheet-like substrate, using a coil bar, so that the dry coating film will be 5 to 6 $\mu$m in thickness. After drying at 120° C. for two minutes, the coated substrate was cured at 50° C. for 48 hours to give a thermally transferred sheet of Examples 1 to 31.

Comparative Examples 1 to 5

In the Comparative Examples 1 to 5, thermally transferred sheets were prepared in the same way as in Example 1 except mixing copolymer components as shown in Table 4:

TABLE 4

| copolymer components (wt. %) | hydroxy ethyl acrylate | hydroxy ethyl methacrylate | (other monomers) phenoxy ethyl methacrylate | phenoxy ethoxy ethyl methacrylate | methyl methacrylate | isoboronyl methacrylate | styrene |
|---|---|---|---|---|---|---|---|
| Comp. Ex. 1 | — | — | 50 | — | 30 | 10 | 10 |
| Comp. Ex. 2 | 3 | — | 50 | — | 27 | 10 | 10 |
| Comp. Ex. 3 | 30 | — | 35 | — | 15 | 10 | 10 |
| Comp. Ex. 4 | — | 30 | 35 | — | 15 | 10 | 10 |
| Comp. Ex. 5 | 15 | 15 | 35 | — | 15 | 10 | 10 |

Evaluation of Characteristics

In the Examples 1 to 31 and the Comparative Examples 1 to 5, thus prepared, transfer characteristics of the laminate film, resistance to blocking, running performance under high temperature conditions and surface luster were evaluated as follows:

Transfer Characteristics of a Laminate Film

For the prepared receiver paper, a thermal transfer printer, manufactured by SONY CORPORATION under the trade name of UP-D8800, and an ink ribbon composed of dyes of yellow (Y), magenta (M) and cyan (C), and a laminate film (L), manufactured by SONY CORPORATION under the trade name of UPC-8840, were used. The laminate film L was cut and bonded on the yellow (Y) dye and 20-gradation printing was carried out with yellow signals. Measurements were then made of the transfer start gradation of the laminate film L to the receiver paper. Evaluation was made, depending on the values of the transfer gradation, as follows:

◎: transfer gradation≦ten gradations

○: ten gradations<transfer gradation≦14 gradations

Δ: 14 gradations<transfer gradation≦18 gradations x: 18 gradations<transfer gradation

Resistance Against Blocking

In the course of preparation of a receiver paper, the paint for the dye reception layer was coated on the substrate surface. After drying at 120° C. for two minutes, the coated substrate was sliced to a size of 5 cm by 5 cm, and two sliced pieces of the receiver paper were stacked one on another so that the dye reception layer of one of the pieces of the receiver paper will be contacted with the back surface of the other piece of the receiver paper. A weight 5 kg, with its bottom surface measuring 5 cm by 5 cm, was placed on the stacked pieces of the receiver paper and the resulting test system was allowed to stand at 50° C. for 48 hours. The paired stacked pieces of the receiver paper were then separated from each other on peeling and changes in the shape of the pieces of the receiver paper from the initial state were visually checked. The resistance against blocking was evaluated, depending on the degree of shape changes, as follows:

A: no changes in shape from the initial state

B: partial changes in shape

C: total shape changes

Running Performance Under High Temperature Conditions

For respective receiver paper, a thermal transfer printer, manufactured by SONY CORPORATION under the trade name of UP-D8800, and an ink ribbon composed of dyes of yellow (Y), magenta (M) and cyan (C) and a laminate film (L), manufactured by SONY CORPORATION under the trade name of UPC-8840, were used. Under a condition of 50° C. and 50%, all black continuous printing was performed. At this time, surface conditions after the end of running, the peeling sound during running and the running performance of the receiver paper were visually checked. The running performance under high temperature conditions was evaluated, depending on the degree of the running performance, as follows:

no sticking between the receiver paper and the ink ribbon, no running sound nor running troubles slight running sound, but not sticking of the receiver paper and the ink ribbon nor running troubles considerable running sound but not sticking of the receiver paper and the ink ribbon nor running troubles sticking of the receiver paper and the ink ribbon and running troubles.

Surface Luster

The surface luster of the receiver paper was evaluated by visually observing the luster of the receiver paper surface. The surface luster was evaluated, depending on its extent, as follows:

○: good luster and high quality

Δ: luster is slightly inferior, but not so significant as to detract from picture quality x: no luster; loss of luster is so significant as to detract from picture quality The results of evaluation of the transfer characteristics, resistance against blocking and the running performance under high temperature conditions of these laminate films are shown in Table 5. Meanwhile, in Table 5, the transfer characteristics of the laminate film, resistance against blocking, running performance under the high temperature conditions and surface luster are stated as "evaluation 1", "evaluation 2", "evaluation 3", "evaluation 4", respectively.

TABLE 5

| | evaluation 1 | evaluation 2 | evaluation 3 | evaluation 4 |
|---|---|---|---|---|
| Ex. 1 | ○ | A | ○ | ○ |
| Ex. 2 | ◎ | A | ◎ | ○ |
| Ex. 3 | ◎ | A | ◎ | ○ |
| Ex. 4 | ◎ | A | ◎ | ○ |
| Ex. 5 | ◎ | B | ○ | Δ |
| Ex. 6 | ○ | A | ○ | ○ |
| Ex. 7 | ◎ | A | ◎ | ○ |
| Ex. 8 | ◎ | A | ◎ | ○ |
| Ex. 9 | ◎ | A | ◎ | ○ |
| Ex. 10 | ◎ | B | ○ | Δ |
| Ex. 11 | ○ | A | ○ | ○ |
| Ex. 12 | ◎ | A | ◎ | ○ |
| Ex. 13 | ◎ | A | ◎ | ○ |
| Ex. 14 | ◎ | A | ◎ | ○ |
| Ex. 15 | ◎ | A | ○ | Δ |
| Ex. 16 | ◎ | A | ◎ | ○ |

TABLE 5-continued

| | evaluation 1 | evaluation 2 | evaluation 3 | evaluation 4 |
|---|---|---|---|---|
| Ex. 17 | ◎ | A | ◎ | ○ |
| Ex. 18 | ◎ | A | ○ | Δ |
| Ex. 19 | ◎ | A | ◎ | ○ |
| Ex. 20 | ◎ | A | ○ | Δ |
| Ex. 21 | ◎ | A | ◎ | ○ |
| Ex. 22 | ◎ | A | ○ | ○ |
| Ex. 23 | ◎ | A | ○ | ○ |
| Ex. 24 | ○ | A | ○ | ○ |
| Ex. 25 | ◎ | A | ○ | ○ |
| Ex. 26 | ◎ | A | ○ | ○ |
| Ex. 27 | ◎ | A | ◎ | ○ |
| Ex. 28 | ◎ | A | ◎ | ○ |
| Ex. 29 | ◎ | A | ◎ | ○ |
| Ex. 30 | ◎ | A | ◎ | ○ |
| Ex. 31 | ◎ | A | ◎ | ○ |
| Comp. Ex. 1 | x | A | ○ | ○ |
| Comp. Ex. 2 | Δ | B | Δ | ○ |
| Comp. Ex. 3 | ◎ | C | ○ | x |
| Comp. Ex. 4 | ◎ | B | ○ | x |
| Comp. Ex. 5 | ◎ | B | ○ | x |

It is seen from this Table 5 that, in the case of Examples 1 to 31, containing 5 to 25 wt % of hydroxy ehtyl acrylate and/or hydroxy ethyl methacrylate, shown in the above chemical formula 1, superior effects are displayed in transfer characteristics of the laminate film, resistance against blocking, running performance under elevated temperatures, and surface luster. That is, if, in the copolymer contained in the dye reception layer, the proportions of hydroxy ethyl acrylate and/or hydroxy ethyl methacrylate shown in the chemical formula 1 are prescribed to be within pre-set ranges, the laminate film can be positively transferred to the receiver paper for positively suppressing the blocking. Moreover, positive running may be assured under high temperature conditions, whilst superior surface luster is displayed.

From the above description it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed:

1. A receiver paper comprising a substrate and a dye reception layer formed on the substrate, wherein the dye reception layer comprises a copolymer comprising a compound having the following formula (1):

Formula (1)

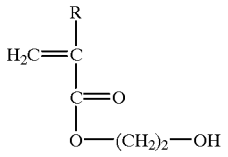

wherein R is H or $CH_3$, the copolymer further comprising another monomer, and wherein the compound having said formula (1) comprises a proportion of the copolymer that ranges from 5 wt % to 25 wt %.

2. The receiver paper according to claim 1 wherein the dye reception layer further comprises a hardener.

* * * * *